United States Patent [19]

Autrey et al.

[11] 4,145,781

[45] Mar. 27, 1979

[54] WATERBED MATTRESS AND FOUNDATION

[76] Inventors: Robert C. Autrey, 95 Mountain View Rd., Santa Cruz, Calif. 95065; John W. Connolly, 40774 Fremont Blvd., Fremont, Calif. 94538

[21] Appl. No.: 859,921

[22] Filed: Dec. 12, 1977

Related U.S. Application Data

[63] Continuation-in-part of Ser. No. 759,381, Jan. 14, 1977, Pat. No. 4,062,077.

[51] Int. Cl.[2] ..... A47C 27/08

[52] U.S. Cl. ..... 5/370; 5/60; 5/334 C

[58] Field of Search ..... 5/60, 365, 368–371, 5/334 R, 335 C

[56] References Cited

U.S. PATENT DOCUMENTS

| | | | |
|---|---|---|---|
| 3,393,937 | 7/1968 | Nehmer | 5/368 |
| 3,840,921 | 10/1974 | LaBaianco | 5/370 |
| 4,015,299 | 4/1977 | Tinnel | 5/370 |
| 4,062,077 | 12/1977 | Autrey et al. | 5/365 |
| 4,073,019 | 2/1978 | Fraser | 5/365 |

*Primary Examiner*—Casmir A. Nunberg
*Attorney, Agent, or Firm*—Flehr, Hohbach, Test, Albritton & Herbert

[57] ABSTRACT

Waterbed mattress and foundation having the size and appearance of a conventional bed. An inner water mattress is supported laterally by a circumscribing framework, and an outer shell is removably mounted over the framework. The shell comprises a peripheral cushion and a padded covering which is tailored to have the appearance of a conventional mattress. The water mattress rests in a cavity in a foundation having the external appearance of a conventional innerspring mattress foundation.

13 Claims, 6 Drawing Figures

WATERBED MATTRESS AND FOUNDATION

CROSS-REFERENCE TO RELATED APPLICATION

This is a continuation-in-part of Ser. No. 759,381, filed Jan. 14, 1977, now U.S. Pat. No. 4,062,077.

BACKGROUND OF THE INVENTION

This invention pertains generally to beds and mattresses and more particularly to a bed of the type having a water filled mattress.

Although waterbeds have enjoyed a widespread popularity in recent years, the waterbeds heretofore provided have had certain limitations and disadvantages. For example, the weight of the water makes such beds unsafe for use in some older buildings, and once filled the beds cannot be moved for cleaning or the rearrangement of furniture without draining the water.

Prior waterbeds have not been totally compatible with existing furnishings. The relatively large wooden frame which surrounds most waterbeds makes such beds larger than conventional beds of equivalent size, and the frame is uncomfortable to sit on and difficult to climb over in getting into or out of the bed. Largely because of the weight of the water and the problem of supporting this weight, waterbeds have generally been placed directly upon the floor or on a relatively low platform or base, which makes them even more difficult to use.

SUMMARY AND OBJECTS OF THE INVENTION

The invention provides a waterbed mattress and foundation having the same general size and appearance as an innerspring mattress and foundation. A water mattress rests on a horizontal base and is bounded laterally by a rigid circumscribing frame which is spaced inwardly from the periphery of the base. Upper and lower peripheral cushions extend along the upper and outer sides of the frame, and a flexible cover extends over the water mattress and upper cushion to give the appearance of a conventional innerspring mattress. A separate cover extends over the outer sides of the lower cushion and base and is tailored to have the external appearance of a conventional foundation for an innerspring mattress. Another cushion extends around the inner perimeter of the frame and has a downwardly and inwardly inclined upper surface which underlies the lateral margins of the water mattress.

It is in general an object of the invention to provide a new and improved waterbed.

Another object of the invention is to provide a waterbed of the above character which has the appearance of a conventional innerspring mattress and foundation set.

Additional objects and features of the invention will be apparent from the following description in which the preferred embodiments are set forth in detail in conjunction with the accompanying drawings.

DESCRIPTION OF THE PREFERRED EMBODIMENTS

Figure 1:
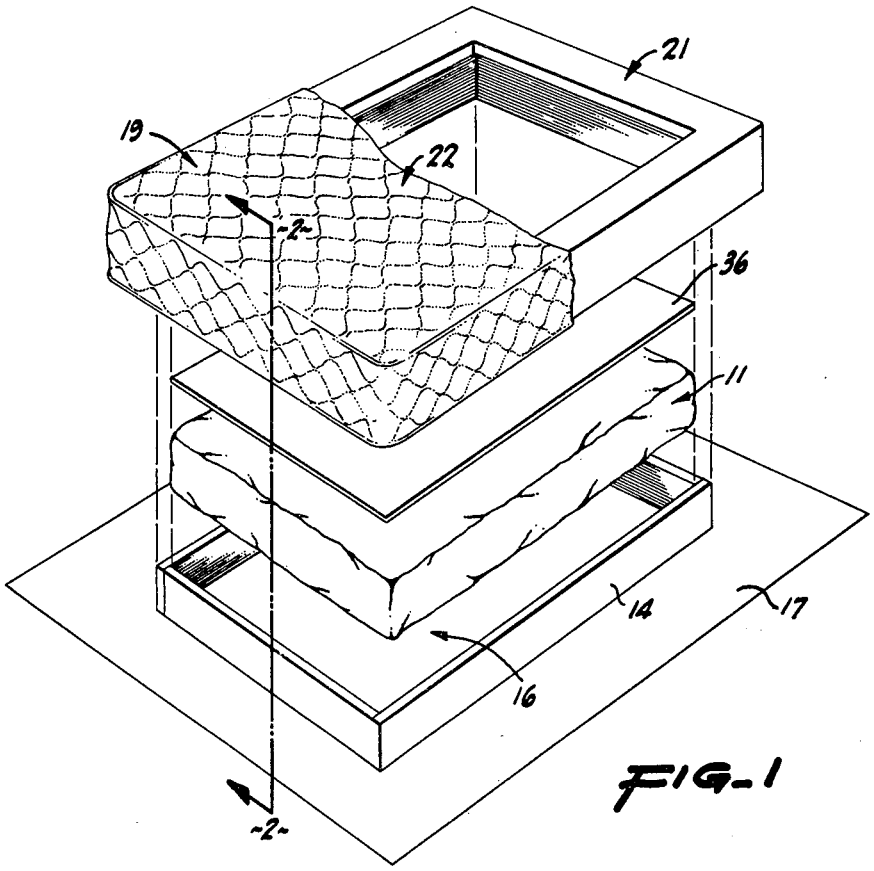
FIG. 1 is an exploded perspective view, partly broken away, of one embodiment of a mattress construction incorporating the invention.
Figure 2:
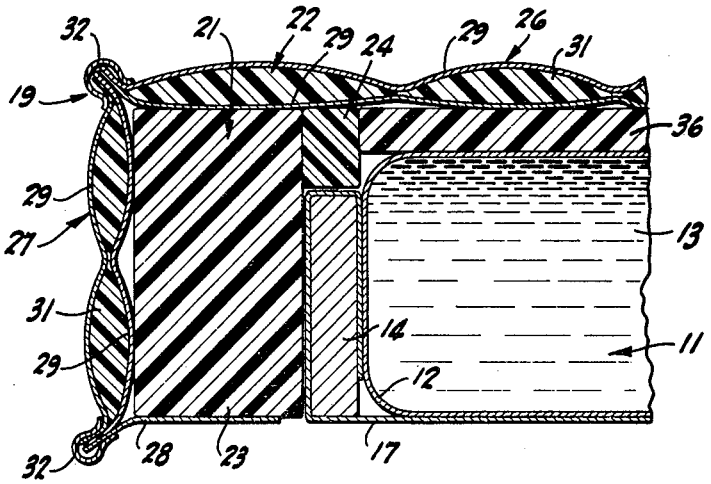
FIG. 2 is an enlarged, fragmentary cross-sectional view taken along line 2—2 of FIG. 1.
Figure 3:
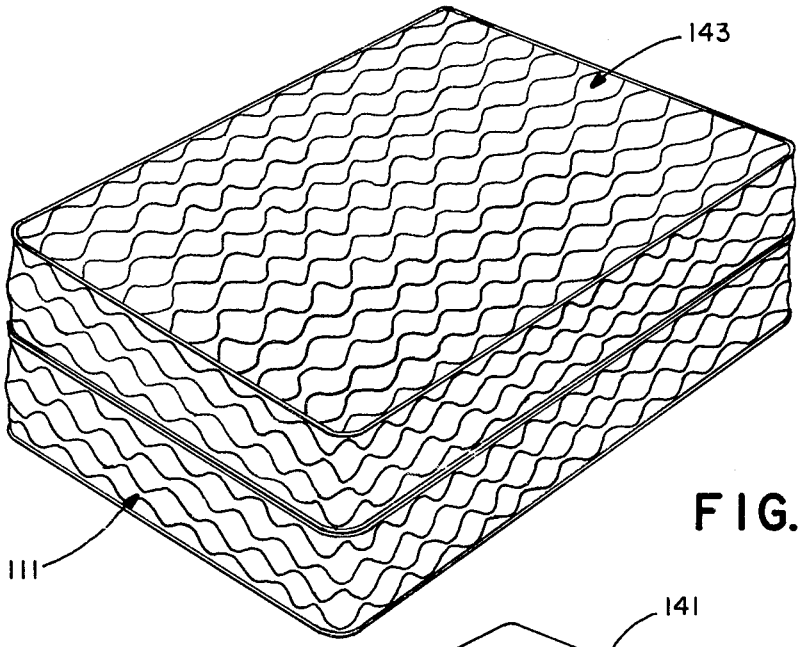
FIG. 3 is an isometric view of another embodiment of a waterbed according to the invention.
Figure 4:
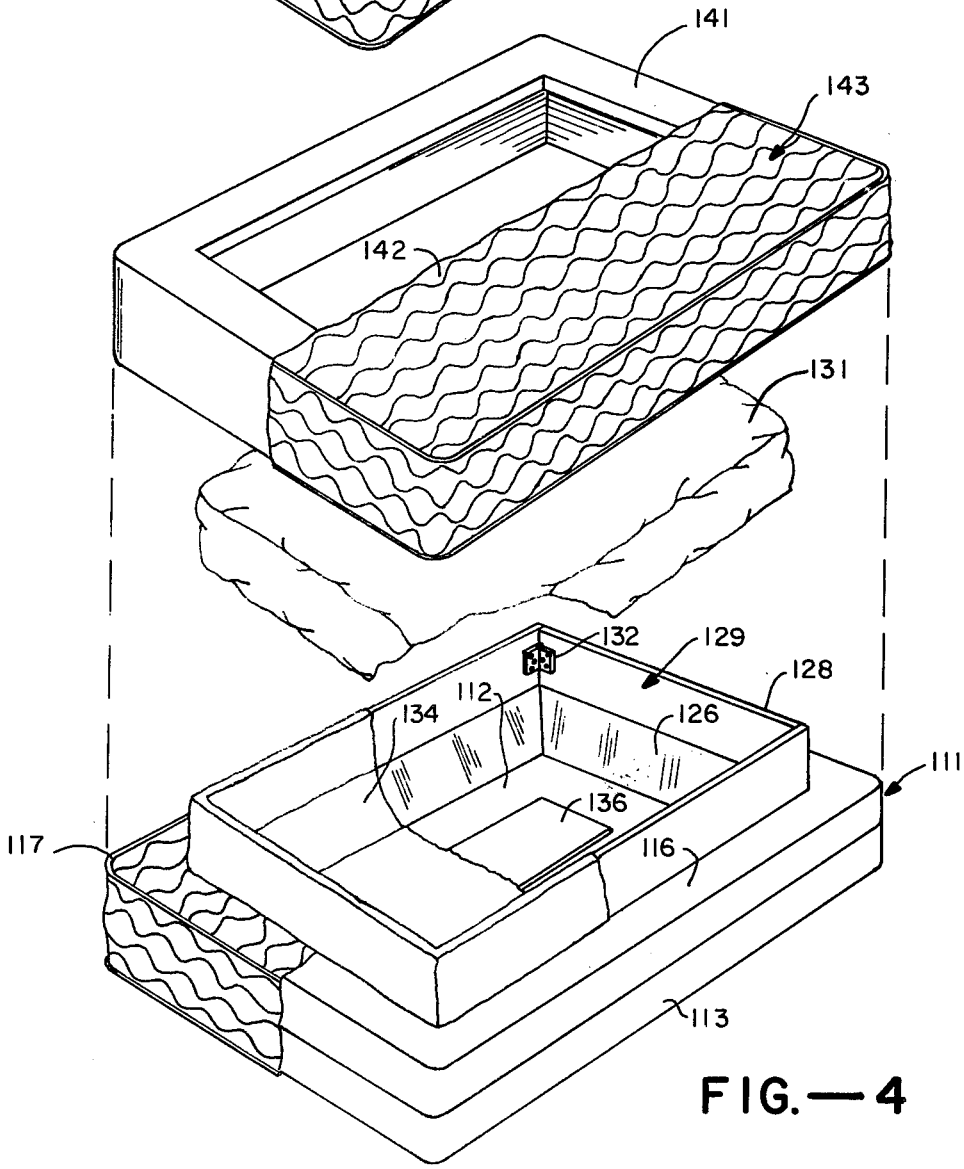
FIG. 4 is an exploded isometric view, partly broken away, of the waterbed of FIG. 3.
Figure 5:
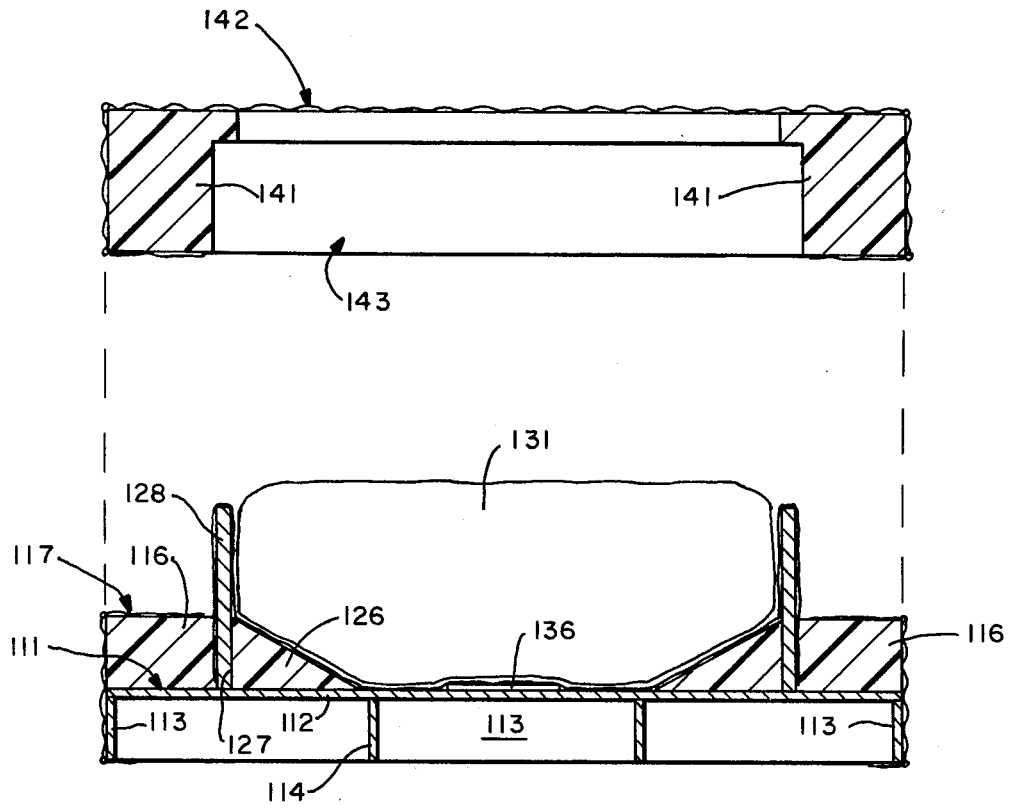
FIG. 5 is an exploded sectional view of the waterbed of FIG. 3.
Figure 6:
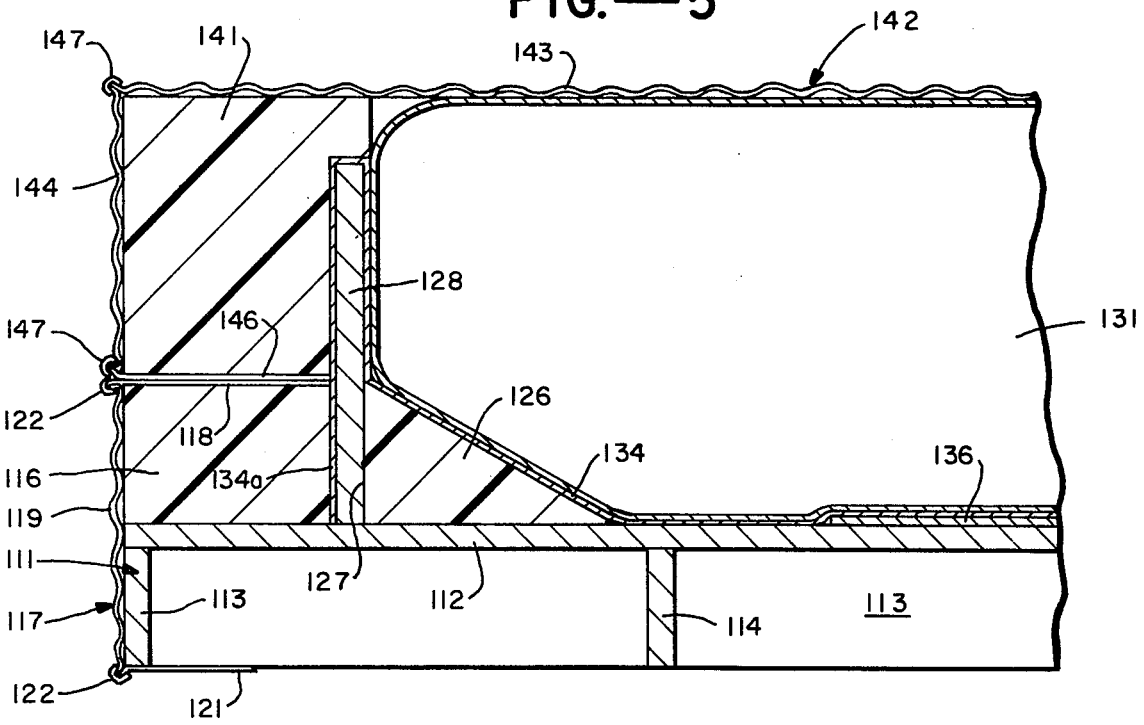
FIG. 6 is an enlarged fragmentary sectional view of the waterbed of FIG. 3.

The mattress construction of FIGS. 1–2 includes a water mattress 11 comprising a flexible bladder 12 enclosing a body of water 13. A rigid circumscribing framework 14 defines a cavity 16 for the mattress and provides lateral support for the body of water. The framework is fabricated of a suitable material such as wood and, as illustrated, is open at the bottom. A flexible safety liner 17 extends across the open bottom and is folded up along the outer sides of the framework. The liner extends across the tops of the frame members and is secured to the inside of the frame by suitable means such as stapling. In the preferred embodiment, the bladder is fabricated of a 22 mil vinyl, and the liner is fabricated of a 12 mil vinyl.

An outer shell 19 is removably mounted on the framework and mattress. This shell compries a peripheral cushion 21 and a flexible cover 22. The cushion is fabricated of four lengths 23 of polyurethane foam joined together to form a rectangular frame of slightly larger dimension than framework 14. Additional pieces of foam 24 are affixed along the upper inside edges of lengths 23 and overlie the framework. In the preferred embodiment, the foam from which cushion 21 is fabricated is a 1.8 pound polyurethane foam having an ILD (indent load deflection) number on the order of 50–80.

As illustrated in FIG. 2, cover 22 includes a top panel 26 which extends over the tops of the water mattress and cushion, a side panel 27 which extends along the outer side of the cushion, and a bottom panel 28 which extends along the underside of the cushion. The top and side panels include superposed sheets 29 of fabric and an intermediate layer of padding 31 which, in the preferred embodiment, is a one pound polyurethane foam having an ILD number of 10–12. The materials forming the top and side panels are sewed together in a quilted pattern to give the mattress the appearance of a conventional innerspring mattress, and the side panel is joined to the top and bottom panels by binding tape 32 and stitching (not shown) along the upper and lower side edges of the cushion. The bottom panel is secured to the lower side of the cushion, and in the embodiment illustrated, this panel comprises a single sheet of fabric, although it can also be of quilted construction, if desired.

An insulative pad 36 extends over the top of the water mattress below cover 22. The embodiment illustrated, this pad is fabricated of a 1.2 pound polyurethane foam having the ILD number on the order of 30–36, and the upper surface of the pad is generally level with the top of cushion 21.

As indicated above, the mattress construction has the size and appearance of a conventional innerspring mattress. A twin size mattress might, for example, be 75 inches long, 39 inches wide, and 8 inches thick. For such a mattress, framework 14 can be constructed of $1 \times 5$ inch lumber, and cushion members 21 would be on the order of 7 inches high and 4 inches wide, with the pieces 24 which overhand the frame being on the order of 1 inch wide and 2 inches high. Water mattress 13 would be on the order of 5–6 inches high, and insulating pad 36 would be on the order of 1 inch thick. The foam padding in the top and side panels of the cover is preferably on the order of 3/16 to 1 inch in thickness.

In use, the mattress is placed on a suitable support such as a solid box foundation of conventional design. Such a foundation includes a plurality of horizontally extending wooden slats which support the mattress and can be provided with a covering which matches cover 22. The foundation can rest upon a metal frame or other conventional bed frame having a headboard and/or foot board.

The mattress is installed by stapling liner 17 to framework 14 and placing the assembled framework on the foundation. Bladder 12 is placed in cavity 16 and filled with water, following which pad 36 is placed over the water mattress and outer shell 19 is placed over the mattress and frame. If the water mattress should ever require repair or adjustment, the outer shell and insulative pad are easily removed to permit access to the water mattress and frame.

While the mattress construction has the size and appearance of a conventional innerspring mattress, it also has the advantages of a waterbed. The support provided by the mattress is a combination of flotation on the body of water and the hammock-like effect of cover 19. Cushion 21 provides relatively firm, confortable seating at the periphery of the mattress and results in a waterbed which is easy to get onto and off of. The padding above frame 14 makes the rigid frame substantially imperceptible to a person resting toward the edge of the mattress. Insulative pad 36 and cover 19 provide thermal insulation and make it unnecessary to heat the water in the bladder. In addition, these pads provide additional support which tends to prevent "bottoming out" when a person suddenly shifts his weight on the mattress.

The waterbed of FIGS. 3–6 has a generally rectangular base 111 which is fabricated of wood or other rigid material. The base includes a horizontally extending platform 112, side walls 113 and internal braces 114. A pollyurethane foam cushion 116 is secured to the upper surface of platform 112 and extends around the periphery of the base. The outer surfaces of the cushion and base are covered with a tailored covering 117 which gives the structure the external appearance of a conventional foundation for an innerspring mattress. This cover includes an upper panel 118 which is secured to the upper surface of cushion 116, a quilted side panel 119 which extends over the outer surfaces of cushion 16 and side wall 113, and a lower panel 121 which is secured to the lower side of the base. The panels are joined together by binding tape 122 and stiching (not shown) at the upper and lower edges of the side panel.

A polyurethane foam cushion 126 of generally triangular cross section is mounted on the upper surface of platform 112 and extends around the platform next to cushion 116. The confronting faces of the cushions are spaced apart, to form a slot 127, and the upper surface of cushion 126 is inclined inwardly and downwardly.

A rigid rectangular frame 128 is removably mounted in slot 127 and with platform 112 defines a cavity 129 in which a water mattress 131 is disposed. The frame extends above the upper surface of cushion 116 and provides lateral support for the water in mattress 131. Additional lateral support is provided by the inclined upper surface of cushion 126. In the embodiment illustrated, frame 128 is formed in four sections which are releasably secured together at the corners by hinges 132 with removable pins.

A flexible safety liner 134 of water impervious material extends beneath the water mattress and over the top and sides of frame 128. The outer portion **134*a* of the liner is tucked between cushion 116 and the lower portion of the frame. A generally planar heating element 136 of conventional design rests on platform 112** beneath the water mattress and liner.

An upper peripheral cushion 141 is mounted above cushion 116 and extends along the upper and outer sides of frame 128. The upper surface of cushion 141 is generally level with the upper surface of water mattress 131. A flexible cover 142 extends over the water mattress and the upper and outer sides of cushion 141 and is tailored to give this portion of the structure the appearance of a conventional innerspring mattress. This cover includes a quilted upper panel 143 which extends over the mattress and the upper surface of cushion 141, a quilted side panel 144 which extends along the side of the cushion a lower panel 146 which is secured to the lower surface of the cushion. The panels are joined together by binding tape 147 and stiching (not shown) along the upper and lower edges of the side panel. Cushion 141 and cover 142 form a shell 143 which is removable as a unit from the remainder of the bed.

In operation and use, foundation or base 111 is placed on a suitable support such as a conventional bed frame. Frame 128 is assembled in slot 127, and after heater 136 and liner 134 are installed, water mattress 131 is placed in cavity 129 and filled. When shell 143 is placed in position, the bed can be made up and used in the manner of a conventional bed.

The invention has a number of important features and advantages. Having the size and appearance of a conventional mattress, the waterbed mattress can be utilized with traditional furnishings and in circumstances where prior waterbeds could not be used. The mattress weighs substantially less than a conventional waterbed, and it can be moved for cleaning or rearranging of furniture. The outer shell remains neatly tailored, and the mattress can be used with standard size linens and blankets, including fitted sheets.

It is apparent from the foregoing that a new and improved waterbed mattress construction has been provided. While only certain presently preferred embodiments have been described in detail, as will be apparent to those familiar with the art, certain changes and modifications can be made without departing from the scope of the invention as defined by the following claims.

What is claimed is:

1. In a waterbed: a horizontally extending base, a water mattress of lesser horizontal extent than the base, a rigid frame mounted on the base and spaced inwardly from the periphery of the base for exteriorly engaging the water mattress to provide lateral support therefore, a peripheral cushion of lesser height than the frame mounted on the base outside the frame, an upper cushion extending along the upper and outer portions of the frame, and a flexible cover overlying the mattress and the upper cushion.

2. The waterbed of claim 1 wherein the cover is secured to the upper cushion, and the cover and upper cushion are removable as a unit from the base and frame.

3. The waterbed of claim 1 wherein the frame is removably mounted on the base.

4. The waterbed of claim 3 further including an additional cushion mounted on the base and spaced inwardly of the peripheral cushion to form a slot in which the frame is mounted.

5. The waterbed of claim 4 wherein the additional cushion has an inwardly and downwardly inclined upper surface underlying the lateral margins of the water mattress.

6. The waterbed of claim 1 wherein the cover extends over the outer sides of the upper cushion, and the outer sides of the peripheral cushion and base are covered with a corresponding cover, whereby the waterbed has the appearance of an innerspring mattress and foundation set.

7. The waterbed of claim 1 further including a water impervious liner extending beneath the mattress and along the inner, top and outer sides of the frame, the outer portion of the liner being tucked between the frame and the peripheral cushion.

8. In a waterbed: a generally rectangular base having a generally horizontal upper surface, an outer peripheral cushion secured to the base and extending around the outer margin of the upper surface, an inner cushion secured to the upper surface of the base and spaced inwardly of the outer cushion to form a slot between said cushions, an upstanding frame removably mounted in the slot, a water mattress disposed within and supported laterally by the frame, and an upper cushion removably mounted on the outer cushion and extending along the upper and outer portions of the frame.

9. The waterbed of claim 8 wherein the inner cushion has an inwardly and downwardly inclined upper surface underlying the lateral margins of the water mattress.

10. In a waterbed: a horizontally extending base, a rigid frame extending upwardly from the base and defining a cavity for receiving a water mattress, said frame being spaced inwardly from the periphery of the base, an external cover extending along the lateral periphery of the base to give the base the outward appearance of a conventional foundation for an innerspring mattress, and a peripheral cushion and overlying cover removably mounted on the base and having the outward appearance of a conventional innerspring mattress, the peripheral cushion being positioned between the frame and the periphery of the base.

11. The waterbed of claim 10 wherein the base includes a generally horizontal platform and a peripheral cushion mounted on the platform beneath the first named cushion.

12. The waterbed of claim 10 wherein the cavity for the water mattress extends below the upper surface of the base.

13. In a waterbed: a generally rectangular base having a generally horizontal upper surface, an outer peripheral cushion secured to the base and extending around the outer margin of the upper surface, an inner cushion secured to the upper surface of the base and spaced inwardly from the outer cushion to form a slot between said cushions, an upstanding frame removably mounted in the slot, a water mattress disposed within and supported laterally by the frame, an upper cushion removably mounted on the outer cushion and extending along the upper and outer portions of the frame, a first flexible cover extending over the upper cushion and mattress, and a second flexible cover extending over the outer side surfaces of the peripheral cushion and base to give the waterbed the appearance of an innerspring mattress and foundation set.

* * * * *